United States Patent [19]

Merrell

[11] Patent Number: 4,706,579

[45] Date of Patent: Nov. 17, 1987

[54] METHOD OF REDUCING FIRESIDE DEPOSITION FROM THE COMBUSTION OF SOLID FUELS

[75] Inventor: Gene A. Merrell, Huntingdon Valley, Pa.

[73] Assignee: Betz Laboratories, Inc., Trevose, Pa.

[21] Appl. No.: 899,188

[22] Filed: Aug. 21, 1986

[51] Int. Cl.[4] ..... F23B 7/00

[52] U.S. Cl. ..... 110/343; 110/345

[58] Field of Search ..... 110/342, 343, 344, 345; 44/1 SR

[56] References Cited

U.S. PATENT DOCUMENTS

| | | | |
|---|---|---|---|
| 2,935,956 | 5/1960 | Welch et al. | 110/343 |
| 4,322,218 | 3/1982 | Nozaki | 110/345 X |
| 4,388,877 | 6/1983 | Molayem et al. | 110/342 |

*Primary Examiner*—Edward G. Favors

*Attorney, Agent, or Firm*—Alexander D. Ricci; Bruce E. Peacock

[57] ABSTRACT

In a solid fuel furnace, such as a boiler, having a combustion zone in which the fuel is fired, a convection zone located downstream from said combustion zone and having a plurality of heater tubes disposed therein adapted to heat water or steam disposed therein, and in which convection zone combustion resides emanating from said solid fuel have a tendency to stick to or agglomerate upon said tubes, a method of decreasing said tendency to stick or agglomerate, comprising burning said fuel in the presence of a chromium containing compound adapted to form a chromium oxide compound upon combustion thereof.

15 Claims, No Drawings

METHOD OF REDUCING FIRESIDE DEPOSITION FROM THE COMBUSTION OF SOLID FUELS

FIELD OF THE INVENTION

The present invention pertains to a method of reducing the formation of fireside deposits in the high temperature regions of combustion systems fired with solid fuels. A conditioning agent is introduced into the combustion system to increase the fusion temperature of the fuel ash, to reduce the adhesion of the fuel ash to the fireside surfaces, and to reduce the compressive strength of the deposits formed. These modifications in fuel ash properties result in the formation of smaller, less tenacious fireside deposits, which may be more easily removed by conventional cleaning methods.

BACKGROUND OF THE INVENTION

When burned, all but a few fuels have solid residues, commonly called ash. The management of this ash is a major consideration in the design and operations of all combustion systems. A portion of the ash is carried with the flue gas to particulate collection equipment (fly ash). Another portion of the ash is continuously discharged through the bottom of the furnace (bottom ash) as a dry, friable residue (dry bottom furnace) or as a molten, flowing residue (cyclone furnace, or wet-bottom furnace). The remainder of the ash collects on the fireside surfaces as either a loosely adhering material that is easily removed by conventional mechanical methods (wall-blowers, sootblowers, lances, etc.) or a strongly adhering, tenacious deposit that resists the normal cleaning techniques. The present invention is directed at inhibiting the formation of these troublesome deposits and increasing the ease of their removal.

Two types of high temperature, fireside deposits are observed in combustion systems; slagging and fouling. Slagging is generally located in the radiant section or furnace and is typified by hard, dense, glassy deposits that may be molten on the outer surfaces. Fouling deposits are generally located in the non-radiant sections, such as the convection section of boilers, and are typically hard, sintered masses of fly ash.

Slagging results from the attachment of plastic or molten ash particles to the fireside surfaces. These surfaces may include refractory, water-wall tubes, steam tubes, superheater tubes, hangers, and other structural members. The attachment may be physical in nature, such as the penetration of the molten ash into the pores of the surface, or chemical in nature, with changes in the composition of the interface between the ash and the fireside surface. This attachment is enhanced by the presence of low melting point ash components, such as alkali metal and alkaline earth compounds, on the fireside surface. These low melting point compositions act as fluxes, increasing the degree of interaction between the surface and the ash. The plastic or molten ash particles solidify rapidly on contact with the fireside surface. A portion of the solidified ash may be crystalline, while the remainder is glassy in nature. The proportion of crystalline to glassy phase depends on the composition of the ash and the prevalent time/temperature conditions of deposition. The degree of adherence (adhesion strength) is dependent on the chemistry of the ash droplet and the relative difference between the surface temperature and the fusion temperature of the ash droplet. Additional ash deposits on this base. These particles may. be small glassy, fly ash spheres or the plastic or molten ash droplets. The interparticle strength increases as the particles sinter. As this insulating layer grows, the temperature of the outer portion increases, and the particles sinter more completely. The insulating layer continues to grow until the surface temperature of the deposit reaches the fusion temperature of the ash. At this point, the surface becomes plastic and then fluid.

The result of this process is the formation of a dense, adherent deposit. These deposits may cause several deleterious effects. Large sections of the deposit may break loose under their own weight or other stresses, blocking the bottom ash hopper throat or causing structural damage. The insulating nature of the slag reduces the heat transfer to the furnace walls, resulting in higher flue gas temperatures downstream of the slagged area. This will increase the potential for additional slagging and fouling, and possible loss of process control. These deposits may bridge across gas passages, restricting the flow of the flue gas, increasing erosion, and creating localized thermal stress. Slagging may cause spalling of refractory surfaces, or under-deposit corrosion may occur.

The standard methods of cleaning the fireside surfaces are mechanical or operational in nature. Devices such as wall-blowers or sootblowers are installed to blow the ash from the surfaces. Air, water, and steam are the standard media. These methods are frequently unsuccessful in removing the deposits. In addition, the frequency of use during slagging periods increases the rate of mechanical and thermal destruction of the surfaces. The level of excess air used for combustion is often increased to lower the temperatures in the furnace and change the oxidation state of the iron constituents in the ash. This should decrease the severity of the slagging, but reduces the efficiency of the operation. Load reductions, either temporary or permanent, reduce the flue gas temperatures and the ash burden. However, production rate reductions result. In many cases, the combustion system must be shut-down for off-line cleaning.

Fouling results from the condensation/desublimation of the more volatile ash constituents onto the fireside surfaces, with the subsequent impaction and adherence of dry, glassy fly ash spheres. These deposits are typically found in those sections of the combustion systems in which the flue gas temperatures are below the fusion temperature of the bulk of the deposit, such as the convection section or boiler bank. Fouling is initiated by the condensation/desublimation of the more volatile ash constituents, such as the alkali metal compounds, on to the relatively cold fireside surfaces. This forms a thin, tacky layer that enhances the capture of fly ash from the flue gas stream. These low melting point compounds may also condense onto the surfaces of fly ash particles, giving them tackiness and increasing the probability of their adhering to the fireside surfaces or other fly ash particles. As the fly ash collects on this base, the insulating nature of the deposit causes the temperature of the outer layer to increase, and the particles sinter. The extent of the sintering depends on several factors. Sintering is a temperature and time dependent process; higher temperatures increase the sintering rate, and the longer the deposit remains at the high temperatures the greater the densification. The presence of the low melting point substances enhance sintering through a fluxing mechanism. The reaction of flue gas sulfur dioxide and sulfur trioxide with the deposit, so called sulfation, increases the strength and tenacity of the deposit. If the flue gas temperatures become sufficiently high, the surface of the sintered deposit becomes plastic in nature.

The result of the fouling process is the formation of large, tenacious, sintered deposits. In the case of steam generator, these deposits inhibit heat transfer, making it difficult to maintain steam temperatures, and promoting additional deposition downstream. Fouling deposits can grow to the extent of blocking gas passages, restricting or diverting flue gas flow, increasing erosion, and creating localized thermal stresses. Under-deposit corrosion may also result.

The standard methods of cleaning fouled fireside surfaces included those described for removing slag. In addition to those, shot-gunning and rodding are frequently used methods. Although these are generally successful during the early stages, the extent of deposition usually proceeds to the point where the standard methods can not maintain satisfactory cleanliness. The shot-gunning and rodding techniques are undesirable because of the man-power intensive nature of those activities, the danger to the personnel, and the potential for puncturing the steam tubes. Ultimately, the combustion system will have to be shut down for cleaning.

PRIOR ART

In addition to the standard mechanical cleaning methods, many and varied chemical solutions have been proposed. For instance, in U.S. Pat. No. 4,372,227 (Mahoney et al), entitled "Method of Reducing High Temperature Slagging in Furnaces," it is suggested to add one or more finely divided substances form the group consisting of silicon carbide and aluminum nitride to the flue gases upstream of the slagging region but downstream of the combustion region proper.

Of similar import are U.S. Pat. Nos. 3,249,075 (Nelson et al) and 3,817,722 (Scott). The Nelson patent discloses the use of silica and compounds of silica with at least one oxide selected from the group consisting of sodium oxide, potassium oxide, calcium oxide, magnesium oxide, titanium oxide, and aluminum oxide, added to the fuel combustion products, to combat high temperature corrosion and ash bonding during the operation of furnaces. The Scott patent discloses the use of an $SiO_2$-MgO mixture to inhibit corrosion and ash deposition is fossil fuel burning equipment.

U.S Pat. No. 4,190,421 (Hwa) describes a fireside treating composition consisting essentially of powdered coal and a fuel additive in a coal:additive ratio of 1:10 to 10:1, in which the additive is a member selected from the group consisting of ammonium chloride, magnesium oxide, alumina, and copper carbonate.

In U.S. Pat. No. 4,253,408 (Kramer), entitled "Method of Protecting Incinerator Surfaces ", it is suggested that sewage be mixed with additive materials selected from the group $SiO_2$, CaO, $Al_2O_3$, and MgO to form combustion products having fusion temperatures above the operating temperatures of the incinerator surfaces.

Other patents which may be of interest include U.S. Pat. Nos. 2,059,388 (Nelms), 4,329,324 (Jones), 4,369,719 (Engstrom et al), and 4,458,606 (Merrell).

Nonproprietary additives have also been examined. The use of copper oxychloride to reduce slagging is described in "Copper Oxychloride—Its Effectiveness as a Coal Additive to Reduce Slagging in Utility Boiler Furnaces," A. Sanyal, J. Inst. Energy, September, 1982. Various additives were examined in "The Use of Additives to Reduce Ash Fouling Problems in Lignite-Fired Boilers," Honea et al, Joint Power Generation Conf., Pheonix, AZ, September, 1980, 80-JPGC/Fu-3.

DETAILED DESCRIPTION OF THE INVENTION

Despite the above-aentioned prior art efforts, there remains a need in the art for an additive, adapted specifically for utilization in conjunction with solid fuels, which minimizes slagging and fouling tendencies and provides for more friable combustion residues. Such friable deposits, when they adhere to fireside surfaces, may be more readily removed from these surfaces by wall-blowers, sootblowers, and the like.

The present application is therefore directed toward a solid fuel additive which is adapted to provide a more friable ash deposit in the fireside sections of combustion systems.

Specifically, the fuel additive of the present invention comprises $Cr_2O_3$, and compounds that would convert to chromium oxides in the combustion system. Exemplary compounds are $Cr_2O_3$, $CaCrO_4$, $Cr(NO_3)_3$, $Cr_2(SO_4)_3$, $Cr(C_2H_3O_2)_3$, $Cr(CO)_6$, $Cr(OH)_2$, $CrO_3$, $Cr(C_5H_7O_2)_3$, $MnCr_2O_4$, $MgCr_2O_4$, $CuCr_2O_7$, $BaCr_2O_7$, $(NH_4)_2Cr_2O_7$, and the like. It has been demonstrated that chromium oxides (a) increase the fusion temperature of fuel ashes and fireside deposits, (b) reduce the adhesion strength between the deposit and the fireside surface, and (c) reduce the compressive strength of the deposit. Therefore, such products will minimize the tendency of the solid fuel combustion residue ashes to adhere to the fireside surfaces and will render any resulting combustion ash deposits friable, so that the deposits may be readily removed from these surfaces by conventional cleaning methods.

The chromium compounds of the invention may be admitted into any type of combustion system firing solid fuels. These combustion systems may include furnaces, boilers, incinerators, kilns, and gasifiers. The solid fuels may include, but are not limited to, coal, refuse, wood, peat, sewage, and a variety of waste products. These fuels may be fired singly, in combination, or in the presence of liquid or gaseous fuels. Ideally, these additives are used in conjunction with the firing of coal. All types of boilers, including cyclone, pulverized coal, and stoker fed boilers, may be beneficially treated with the chromium additive of the present invention.

In combustion systems fired with solid fuels, the tendency is for sticky, tenacious ash deposits to form on or around furnace walls, steam tubes, hangers, and other structural members exposed to the combustion residues. To minimize the deleterious effects of these deposits, the fuel is fired in the presence of the fuel additive, either by adding the additive directly to the fuel, injecting the additive upstream from the deposition zone so that the turbulent gas forces will carry the additive to the desired working area, or injecting the additive directly onto the deposits.

The additives may either be shot fed or continuously fed. In cyclone or heap firing, it is advantageous to admit the additive into the furnace area, downstream of the combustion zone proper, but upstream of the deposition zone. The additive will be distributed through the combustion system by the turbulent flow of the combustion gases. For stoker and pulverized fuel burning units, the additive may be fed directly with the fuel in lieu of or in addition to possible feeding upstream from the deposition region.

The amount of additive to be used will depend upon many factors, such as the flue gas temperature at the deposition surface, the temperature of the deposition surface, the design of the combustion system, the firing configuration, and, of course, the impurity content and composition of the fuel. The higher the flue gas temperature, the greater is the tendency toward the formation of deposits. With narrowly spaced gas passages, such as superheater tubes, the tendency to clog the passage is greater. The greater the impurity content of the fuel, the greater is the tendency toward the production of deleterious combustion residues. The amount of additive required will, of course, be greater as any of these disadvantageous situations increases in intensity. A greater amount of additive will be necessary when combined with the fuel, as opposed to injection directly to the deposition zone, since a portion of the additive will be carried with the combustion gases to the exit of the combustion system.

The additive of the present invention may be applied as a neat powder, as a solution, or in combination with materials selected from the group consisting of $SiO_2$, $Al_2O_3$, MgO, CaO, $Mg(CO_3)_2$, $Ca(CO_3)_2$, $Cu_2(OH)_3Cl$, combinations of members of this group, or other known efficacious materials.

Operable additive dosage rates encompass use of between trace amounts to about 15.00% (wt %; weight additive as the corresponding chromium oxide: weight of fuel). The lower levels will be operable in shot-feeding applications. Preferably, the chromium oxides of the present invention are added within the range of about 0.001% to 0.25%.

EXAMPLES

The invention will be further illustrated by the following examples, which are included as being illustrative of the invention, but which should not be construed as limiting the scope thereof.

ASTM Ash and Deposit Fusibilities

In order to gauge the efficacy of the chromium oxide additive of the present invention in increasing the fusion temperature of the solid fuel ash or deposit, this additive was subjected to the ASTM D-1857 "Fusibility of Coal and Coke Ash" test method. The results from these tests provide an indication of how the mineral matter in the fuel may behave in a furnace. Of the four temperatures measured in the test, the softening temperature is commonly called the fusion temperature of the ash. One of the intended purposes of the present invention is to increase the fusion temperature of solid fuel ash and deposits.

Higher fusion temperatures are indicative of a reduced tendency of the ash to stick to fireside surfaces compared to ashes with lower fusion temperatures. In this manner, the relative efficacies of different additives in minimizing the deleterious effects of combustion ashes may be determined by comparing fusion temperatures.

The ASTM fusion tests reported hereinbelow were conducted with the additive material intimately with the ash. Analysis of the fuel ash samples used for testing revealed the following:

TABLE I

Composition of Fuel Ashes (% by weight)

| Component | Fuels A | B | C | D | E |
|---|---|---|---|---|---|
| Silicon, as $SiO_2$ | 26 | 34 | 34 | 49 | 37 |
| Aluminum, as $Al_2O_3$ | 11 | 14 | 18 | 21 | 23 |
| Titanium, as $TiO_2$ | 1 | 1 | 1 | 1 | 1 |
| Iron, as $Fe_2O_3$ | 9 | 5 | 6 | 20 | 33 |
| Calcium, as CaO | 20 | 23 | 23 | 2 | 1 |
| Magnesium, as MgO | 3 | 2 | 4 | | |
| Sodium, as $Na_2O$ | 11 | 6 | | 1 | |
| Potassium, as $K_2O$ | | | | | 1 |
| Barium, as BaO | | | | | |
| Phosphorus, as $P_2O_5$ | | | | 1 | 1 |
| Sulfur, as $SO_3$ | 19 | 15 | 14 | 3 | 3 |

The results of the ASTM fusibility tests are reported in Table II below. In all instances in these tests, the additive, $CR_2O_3$, is mixed with the ash in an amount of 10% (by weight additive to weight ash). The increase in the ASTM fusion temperatures resulting from utilization of the additive was calculated by recording the reference temperatures of the untreated ash, and comparing that value to the reference temperatures measured for the treated ash.

TABLE II

Increase in Fuel Ash ASTM Fusibilities with $Cr_2O_3$ Treatment (F)

| Fuel Ash | Reference Temperature* ID | ST | HT | FT |
|---|---|---|---|---|
| A | 162 | 162 | 180 | 180 |
| B | 90 | 144 | 144 | 144 |
| C | 90 | 144 | 162 | 234 |
| D | 126 | 180 | 288 | >234 |
| E | 198 | 288 | >270 | >234 |

*Definition of Reference Temperatures:
ID = Initial Deformation
ST = Softening Temperature
HT = Hemispherical Temperature
FT = Fluid Temperature It is well known that a combustion system acts as a fractioning column for the ash. This is due to the variable volatility of the ash components. Therefore, the deposit composition and fusibility may be dramatically different from the source fuel ash. In order to demonstrate the efficacy of the additive of the present invention on deposit fusibilities, the ASTM fusibility test was performed on deposits collected from combustion systems. To prepare the deposit sample for testing, the deposit is ground to −100 mesh before forming the test cones or the mixing with additive. In each instance, the additive, Cr203, is mixed intimately with the ground deposit in an amount equal to 10% (weight of additive top weight of ground deposit).

The composition of the deposits used in these tests is provided in Table III. The resultant temperature increases in the ASTM fusibilities upon treatment are given in Table IV.

TABLE III

Composition of Fireside Deposits (% by weight)

| Component | Deposit 1 | 2 | 3 |
|---|---|---|---|
| Silicon, as $SiO_2$ | 52 | 16 | 33 |
| Aluminum, as $Al_2O_3$ | 31 | 7 | 14 |
| Titanium, $TiO_2$ | 1 | | |
| Iron, as $Fe_2O_3$ | 10 | 13 | 20 |
| Calcium, as CaO | 3 | 21 | 21 |
| Magnesium, as MgO | | 4 | 4 |
| Sodium, as $Na_2O$ | | 7 | 4 |
| Potassium, as $K_2O$ | 1 | | |

TABLE III-continued

| Composition of Fireside Deposits (% by weight) | | | |
|---|---|---|---|
| | Deposit | | |
| Component | 1 | 2 | 3 |
| Barium, as BaO | | | 1 |
| Phosphorus, as $P_2O_5$ | 1 | | |
| Sulfur, as $SO_3$ | | 27 | 2 |

TABLE IV

| Increase in Deposit ASTM Fusibilities with $Cr_2O_3$ Treatment (F) | | | | |
|---|---|---|---|---|
| | Reference Temperature* | | | |
| Deposit | ID | ST | HT | FT |
| 1 | 252 | >252 | >108 | >36 |
| 2 | 234 | 234 | 270 | 378 |
| 3 | 72 | 36 | 36 | 144 |

*Definition of Reference Temperatures:
ID = Initial Deformation
ST = Softening Temperature
HT = Hemispherical Temperature
FT = Fluid Temperature It is apparent that the use of chromium oxide results in significant increases in the fusibilities of fuel ashes and combustion residue deposits of widely divergent compositions.

Although the efficacy of the present invention has been demonstrated by the use of $Cr_2O_3$, the skilled artisan will appreciate that any chromium compound will prove effective, in accordance with the invention, provided that the compound converts to a chromium oxide in the combustion system.

Deposit Modification

In order to evaluate the efficacy of the chromium oxide additive of the present invention in decreasing the deposition tendency and tenacity in operating combustion systems, this additive was tested in a combustion system.

Pulverized fuel is fired in a laboratory combustor which simulates the time and temperature conditions of a full scale combustion system. The combustion products, both flue gas and ash, pass over a 1010 carbon steel substrate, which is cooled to simulate a water-wall, superheater, or steam tube in a boiler. Deposits grow on the substrate under those conditions, temperature and flue gas composition, typical of those found in industrial or power boilers. Three critical slagging parameters are measured in each experiment; Time-to-Slag, Adhesion Strength, and Compressive Strength.

The time-to-slag is a visual observation of the time required for a deposit to grow to the point that a molten surface is formed. This parameter is related to the fusion temperature of the deposit. An additive that increases the fusion temperature of the ash will increase the time-to-slag. Greater time-to-slag is indicative of a reduced tendency of the ash to stick to fireside surfaces, a reduced tendency. of deposit to grow, and a reduced tenacity of the resultant deposit.

The adhesion strength is a measure of the force required to remove the deposit from the fireside surfaces. In practice, a dynamometer is introduced into the combustion system to apply a force on the deposit, parallel to the substrate surface. The measured force required to remove the deposit from the substrate is the adhesion strength. A reduced adhesion strength is indicative of a less tenaciously bound deposit and an increased efficiency in cleaning the fireside surfaces by conventional methods such as wall-blowers, sootblowers, and the like.

The compressive strength is a measure of the force required to fracture and break a deposit. In practice, a dynamometer is used to measure the compressive strength of a deposit removed from the laboratory combustor. The force is applied perpendicular to the deposit face, and the measured compressive strength is taken as the force required to fracture the deposit. A reduced compressive strength is indicative of a deposit that be more easily removed by conventional cleaning methods and will be processed more easily by the clinker crushers.

The combustor results reported hereinbelow were conducted with the additive material mixed intimately with the pulverized fuel. The fuels used in these examples are fuels A, B, and C defined in Table I. above. Typical operating conditions for these tests are defined in Table V. below.

TABLE V

| Typical Combustor Operating Conditions | |
|---|---|
| Furnace Temperature (F) | 2900–3000 |
| Fly Gas Temperature in Deposition Zone (F) | 2500–2600 |
| Substrate Temperature (F) | 800–1150 |
| Flue Gas %02 | 2–3.5 |
| Secondary Air Preheat Temperature (F) | 1830 |

Fuel A

The efficacy of the additive of the present invention was compared to that of the conventional slag control additives, $Al_2O_3$, CaO, $CaCO_3$, MgO, $SiO_2$, and $Cu_2(OH)_3Cl$. The additives were mixed with the fuel at a rate of 1% by weight of fuel. The results of the combustor testing are reported in Table VI. as the percent change from the untreated values.

TABLE VI

| Effects of Treatments on Fuel A Slagging Parameters* | | | |
|---|---|---|---|
| Additive | Time-to-Slag % Δ | Adhesion Strength % Δ | Compressive Strength % Δ |
| $Cr_2O_3$ | 82.6 | −74.2 | −80.2 |
| $CaCrO_4$ | 104. | −31.3 | −80.2 |
| $Al_2O_3$ | 104. | −31.3 | −7.6 |
| CaO | −3.3 | −3.4 | −44.6 |
| $CaCO_3$ | 12.8 | 93.2 | −8.9 |
| MgO | 55.8 | −48.5 | −30.0 |
| $SiO_2$ | −57.0 | 5.2 | −63.0 |
| $Cu_2(OH)_3Cl$ | 34.3 | 28.8 | −31.4 |

*The results are reported as the percent change, % Δ, from the untreated value, i.e. % Δ = 100 X (treated - untreated)/(untreated)

No single additive demonstrated the best performance in all the measured parameters, and some provided an improvement in one parameter, but made the others worse. Therefore, it was necessary to use a rating method to establish overall performance. It was decided to weight each parameter equally, taking an increase in time-to-slag as positive result, and decreases in adhesion strength and compressive strength as positive results. In practice, the overall performance factor (OPF) becomes $$OPF = \%\Delta\text{Time-to-slag} - \%\Delta\text{Adehsion Strength} - \%\Delta\text{Compressive Strength}$$

where the greater the OPF, the better the overall performance.

Applying this OPF method of ranking performance to the results presented in Table VI., the following is determined:

| Additive | OPF | Rank |
|---|---|---|
| $Cr_2O_3$ | 237 | 1 |
| $CaCrO_4$ | 216 | 2 |
| $Al_2O_3$ | 143 | 3 |
| MgO | 134 | 4 |
| CaO | 45 | 5 |
| $Cu_2(OH)_3Cl$ | 37 | 6 |
| $SiO_2$ | 1 | 7 |
| $CaCO_3$ | −72 | |

It is apparent that the use of chromium oxide results in significantly reduced slagging tendency and deposit tenacity compared to the untreated tests. In addition, on an equal treatment rate basis, the treatments containing chromium, in accordance with the invention, provide an improvement in the art compared to the well known deposit modifiers $Al_2O_3$, MgO, $Cu_2(OH)_3Cl$, CaO, $SiO_2$, and $CaCO_3$.

In order to ascertain the effect of treatment rate on performance of the additive of the invention, fuel A was treated with $Cr_2O_3$ intimately mixed with the fuel in the range of 0.125 to 1.0% by weight of fuel. The results of this testing are presented in Table VII. below.

TABLE VII

Feedrate Study of $Cr_2O_3$ on Fuel A

| % | Time-to-Slag % Δ | Adhesion Strength % Δ | Crush Strength % Δ | OPF |
|---|---|---|---|---|
| 0.125 | 30 | −37.8 | −34.0 | 102 |
| 0.25 | 50 | −52.8 | −53.8 | 157 |
| 0.5 | 104 | −57.1 | −60.4 | 222 |
| 1.0 | 83 | −74.2 | −80.2 | 237 |

The results of the feedrate study suggest that even at reduced treatment levels, the additive of the invention provides a greater inhibition of slagging tendencies than the prior art at 4 to 8 times the treatment level.

Fuel C

As a means of further demonstrating the efficacy of the chromium additive of the present invention, fuel C was fired in the laboratory combustion system in the presence of $Cr_2O_3$ and the well known slag additives, $Al_2O_3$ and MgO.

In order to demonstrate that the laboratory combustion system generates deposits that are representative of deposits found in full scale combustion systems, the analysis of a laboratory combustor deposit was compared to that of a deposit from a utility boiler firing the same fuel. The results of the analyses are presented in Table VIII. below.

TABLE VIII

Analyses of Laboratory and Field Deposits from Firing Fuel C (%)

| Component | Laboratory Deposit | Field Deposit |
|---|---|---|
| Silicon, as $SiO_2$ | 51 | 54 |
| Aluminum, as $Al_2O_3$ | 18 | 17 |
| Titanium, as $TiO_2$ | 2 | |
| Iron, as $Fe_2O_3$ | 11 | 12 |
| Calcium, as CaO | 17 | 11 |
| Magnesium, as MgO | | 4 |
| Phosphorus, as $P_2O_5$ | | 1 |
| Loss on Ignition | 1 | 1 |

These data demonstrate that the laboratory combustion system provides a satisfactory simulation of the deposits observed in full size combustion systems.

The additive testing with fuel C was performed as described above for ful A. Each additive was mixed intimately with the fuel. The effects of the treatments on the time-to-slag, adhesion strength, and crush strength are compared in Table IX., along with the corresponding overall performance factor (OPF).

TABLE IX

Effect of Treatments on Slagging of Fuel C

| Additive | Time-to-Slag % Δ | Adhesion Strength % Δ | Compressive Strength % Δ | OPF |
|---|---|---|---|---|
| 0.05% $Cr_2O_3$ | 30 | −43 | −20 | 93 |
| 0.3% $Al_2O_3$ | 67 | −37 | −6 | 110 |
| 0.2% MgO | −7 | −32 | −13 | 38 |

It was observed that at one-sixth the treatment level, the chromium additive of the invention provided greater reductions in the adhesion and compressive strengths and approximately the same overall performance as the $Al_2O_3$ additive.

It is again apparent that the chromium additive, as provided for by the present invention, provides a significant reduction in the slagging tendencies and deposit tenacity as compared to untreated fuel.

Fuel B

The improvement in the prior art by the use of the chromium additive of the present invention is further demonstrated with Fuel B. As in the previous two examples, the additive is mixed intimately with the fuel and fired in the laboratory combustor. Table X. compares the efficacy of $Cr_2O_3$ and $Al_2O_3$, each at a 0.25% treatment level.

TABLE X

Effect of 0.25% Treatment on Fuel B Slagging

| Additive | Time-to-Slag % Δ | Adhesion Strength % Δ | Compressive Strength % Δ | OPF |
|---|---|---|---|---|
| $Cr_2O_3$ | 43 | −65 | −14 | 122 |
| $Al_2O_3$ | 7 | 4 | 8 | −5 |

It is further demonstrated that the chromium additive of the invention may be used adventageously in combination with known slag inhibitor additives such as $Al_2O_3$ and $Cu_2(OH)_3Cl$. The performances of three blends are compared to that of the individual components. The blends were

| Blend | % $Cr_2O_3$ | % $Al_2O_3$ | % $Cu_2(OH)_3Cl$ |
|---|---|---|---|
| I | 10 | 90 | |
| II | 75 | | 25 |
| III | 7.5 | 90 | 2.5 |

The results of this comparative testing are presented in Table XI.

TABLE XI

Modification of Fuel B Slagging with Treatments

| Additive | Time-to-Slag % Δ | Adhesion Strength % Δ | Compressive Strength % Δ | OPF % |
|---|---|---|---|---|
| 0.07% $Cr_2O_3$ | 6 | −38 | −11 | 55 |
| 0.08% $Cu_2(OH)_3Cl$ | 24 | 5 | −24 | 43 |
| 0.64% $Al_2O_3$ | 63 | −15 | 0 | 78 |

TABLE XI-continued

| Modification of Fuel B Slagging with Treatments | | | | |
|---|---|---|---|---|
| Additive | Time-to-Slag % Δ | Adhesion Strength % Δ | Compressive Strength % Δ | OPF % |
| 0.35% I | 63 | −36 | −7 | 105 |
| 0.07% II | 33 | −39 | −38 | 110 |
| 0.36% III | 63 | −28 | −9 | 100 |

*Percent by weight of additive in fuel. I, II, III are the blends defined above.

It is evident from the example above using blended treatments, that the addition of the chromium additive of the present invention to additives of the prior art results in significantly increased performance at lower total treatment levels. Although this has been demonstrated with $Al_2O_3$ and $Cu_2(OH)_3Cl$ as the additives of the prior art, similar effects will be observed with other known slag modifier additives.

The efficacy of the chromium additive under shot-feeding treatment conditions was demonstrated by blending the additive with the fuel and firing the treated fuel at intervals between firing untreated fuel. For example, a 1% shot-feed test would be accomplished by firing fuel treated at a 4% level one quarter of the time. This simulates adding shots of treatment to the fuel before the pulverizer.

The results of laboratory combustor testing with 1% and 0.25% shot-feed treatments of $CR_2O_3$ and $Al_2O_3$ are presented in Table XII. In the shot-feed tests, the Time-to-Slag parameter has no significance. Between shots, the surface of the deposit becomes molten, but solidifies as the subsequent additive shot is fired. Therefore, only the Adhesion Strength and Compressive Strengths reductions are reported for the shot-feeding tests.

TABLE XII

| Effect of Shot-Feeding on Fuel B Slagging Parameters | | | |
|---|---|---|---|
| Additive | Adhesion Strength % Δ | Compressive Strength % Δ | OPF* |
| 1% shot | | | |
| $Cr_2O_3$ | −85 | −59 | 144 |
| $Al_2O_3$ | −62 | −74 | 136 |
| 0.25% shot | | | |
| $Cr_2O_3$ | −53 | −63 | 116 |
| $Al_2O_3$ | −61 | −7 | 68 |

*OPF equals the sum of the absolute values of the percent change in the adhesion strength and percent change in the compressive strength.

It is apparent from the shot-feeding treatment results that the chromium additive of the invention provides for a greatly reduced tenacity of slag deposits when fed intermittently. This method of treatment reduces the overall additive requirement compared to continuous feed methods.

Sintering Test

In order to further gauge the efficacy of the chromium oxide additives of the present invention in increasing the friability of combustion ash deposits, this additive was subjected to a sintering test. This test (proposed by Barnhart and Williams, see Trans. of the ASME, 78, p 1229–36; August 1956) is intended to determine the tendency of a particular ash to form hard, bonded deposits in the convection sections of coal-fired boilers. The test involves drying fly ash to constant weight, compressing it into a cylindrical shape, heating it to the desired temperature for a designated time period, slowly cooling the cylinder, and measuring the pressure needed to burst the sintered pellet.

Higher compressive strengths needed to burst similar pellets are indicative of more severe fouling problems when compared to similar pellets which are burst via lower compressive strengths. In this manner, the relative efficacies of fuel additives in minimizing the deleterious effects of combustion ashes may be determined by comparing pellet sintering strengths for treated ashes to untreated ashes.

The fly ash which is pelletized should be representative of the particular ash passing through the combustion system. In this respect, fly ash was collected from the electrostatic precipitator of a western subbituminous coal fired boiler. Analysis of the fly ash is reported below.

| Component | % by weight |
|---|---|
| Silicon, as $SiO_2$ | 46 |
| Aluminum, as $Al_2O_3$ | 9 |
| Titanium, as $TiO_2$ | 1 |
| Iron, as $Fe_2O_3$ | 9 |
| Calcium, as CaO | 13 |
| Magnesium, as MgO | 8 |
| Sodium, as $Na_2O$ | 4 |
| Potassium, as $K_2O$ | 1 |
| Barium, as BaO | 1 |
| Copper, as CuO | 2 |
| Zinc, as ZnO | 1 |
| Phosphorus, as $P_2O_5$ | 1 |
| Sulfur, as $SO_3$ | 2 |

The results of the sintering strength test is reported in Table XIII. below. In this test, the additive, $Cr_2O_3$, was intimately mixed with the ash in an amount of 1% (by weight additive to weight ash). The % reduction in sintering strength resulting from utilization of the additive was calculated by recording the compressive force needed to burst untreated pellets, and comparing that value to the compressive force needed to burst treated pellets sintered at the same temperature.

TABLE XIII

| Percent Reduction in Fly Ash Sintering Strength with 1% $Cr_2O_3$ Addition | |
|---|---|
| Sintering Temperature (F) | Sintering Strength Reduction (%) |
| 1800 | 32 |
| 1700 | 92 |
| 1600 | 87 |
| 1500 | 99 |

It is apparent that the use of the chromium oxide results in significantly reducing the force required to burst the tested pellets.

Although the efficacy of the present invention has been demonstrated by the use of specific chromium compounds, the skilled artisan will appreciate that any chromium compound will prove effective, in accordance with the invention, provided that the chromium compound converts to an oxide in the combustion system.

At present, due to cost considerations, it is preferred to use the chromium compound in the form of a blend in combination with well-known deposit conditioners such as $Al_2OH_3$, $Cu_2(OH)_3$ Cl, etc. The presently preferred composition comprises:

| wt % | |
|---|---|
| 90% | $AlOH_3$ |
| 9% | $Cr_2O_3$ |
| 1% | $Cu_2(OH)_3Cl$ |

While this invention has been described with respect to particular embodiments thereof, it is apparent that numerous other forms and modifications of the invention will be obvious to those skilled in the art. The appended claims and this invention generally should be construed to cover all such obvious forms and modifications which are within the true spirit and scope of the present invention.

I claim:

1. In a solid fuel fired combustion system of the type having a radiant section and a convection section wherein, in the absence of treatment, combustion residues emanating from said solid fuel tend to slag in said radiant section and to form fouling deposits in said convection section the method comprising inhibiting both said slagging and said fouling by adding to said solid fuel an effective amount for the purpose of a composition consisting essentially of a member or members selected from the group consisting of $Cr_2O_3$ and $CaCr_2O_4$.

2. Method as defined in claim 1 comprising burning coal as a fuel.

3. Method as defined in claim 1 comprising burning wood as a fuel.

4. Method as defined in claim 1 comprising burning peat as a fuel.

5. Method as defined in claim 1 comprising burning refuse as a fuel.

6. Method as defined in claim 1 comprising burning sewage as a fuel.

7. Method as defined in claim 1 comprising burning said solid fuel in a boiler.

8. Method as defined in claim 1 comprising burning said solid fuel in a furnace.

9. Method as defined in claim 1 comprising burning said solid fuel in an incinerator.

10. Method as defined in claim 1 comprising burning said solid fuel in a gasifier.

11. Method as defined in claim 1 comprising burning said solid fuel in a kiln.

12. Method as recited in claim 1 comprising adding said chromium compound to said fuel at a rate of about trace - 15 wt chromium compound to weight of said solid fuel.

13. Method as recited in claim 13 comprising adding from about 0.001% –0.25 wt % of said chromium to said fuel.

14. Method as recited in claim 1 where said adding comprises shot feeding.

15. Method as resulted in claim 1 where said adding comprises continuous addition.

* * * * *